US011399999B1

(12) United States Patent
Nyankira

(10) Patent No.: US 11,399,999 B1
(45) Date of Patent: Aug. 2, 2022

(54) EASY DRAIN MATTRESS

(71) Applicant: Ezra M. Nyankira, Grand Prairie, TX (US)

(72) Inventor: Ezra M. Nyankira, Grand Prairie, TX (US)

( * ) Notice: Subject to any disclaimer, the term of this patent is extended or adjusted under 35 U.S.C. 154(b) by 0 days.

(21) Appl. No.: 16/820,759

(22) Filed: Mar. 17, 2020

Related U.S. Application Data

(60) Provisional application No. 62/826,389, filed on Mar. 29, 2019.

(51) Int. Cl.
*A61G 7/02* (2006.01)

(52) U.S. Cl.
CPC ..... *A61G 7/02* (2013.01)

(58) Field of Classification Search
CPC ..... A61G 7/02; A61G 5/1002
See application file for complete search history.

(56) References Cited

U.S. PATENT DOCUMENTS 666,458 A * 1/1901 Ratio ..... A61G 7/02 5/695
4,620,333 A * 11/1986 Ritter ..... A61G 7/02 5/604
2006/0015080 A1* 1/2006 Mahnensmith ..... A61F 5/48 604/327

FOREIGN PATENT DOCUMENTS

FR 2724841 A1 * 3/1996 ..... A61G 7/02

* cited by examiner

*Primary Examiner* — David R Hare
*Assistant Examiner* — Adam C Ortiz
(74) *Attorney, Agent, or Firm* — Law Office of Jeff Williams PLLC; J. Oliver Williams

(57) ABSTRACT

The present invention discloses a drain mattress system which includes a mattress positioned on a bed frame. The drain mattress system is configured to have a collection tubes and a central removable collection tank. The drain mattress system configured to have drain holes that are positioned in the center of the mattress. The center section of the drain mattress system is penetrated with a series of collection tubes that protrude through a lower support surface of the bed frame and are connected to the collection tube, which is then collected in a funnel and directed to the central removable collection tank located under the bed. The drain mattress system automatically drains the fluid to the central removable collection tank enabling the mattress dry. The drain mattress system is attached to a suction vacuum to pull out the fluid and fecal matter.

12 Claims, 8 Drawing Sheets

Section A-A

EASY DRAIN MATTRESS

BACKGROUND OF THE INVENTION

A. Technical Field

The present invention generally relates to mattress used for supporting a person's body and to improve the personal hygiene in a seated or recumbent position and, more particularly, the mattress further prevents or relieves the problems associated with urinary incontinent patients.

B. Description of Related Art

Geriatric health care or any health care, where patients are required to stay in a health facility is one of the most critical processes in improving the quality of life for the patients in modern society. The method of planning and coordinating health care for a person suffering from physical and mental impairments usually means long care needs. Maintaining independence is a significant goal for anyone approaching any life changing situation that involves health care.

Life expectancy is increasing in many societies, so the individual needs of persons living longer are also growing. Many people need more care when getting older due to health circumstances brought on by their aging. It has been estimated that at least seventy percent of older adults now live in middle or low-income demographics. Governments and health care systems ability to provide care for older adults have become an important issue. Innovative and sustainable ways to cope with the demographic shift are becoming more urgent as the population continues to live longer.

Long term care for someone suffering from some debilitating condition requiring the prolonged stay in a bed creates a host of problems for the patients and care takers. It is common for long-term care facilities to provide custodial, medical, and non-skilled care for assisting patients with normal daily routines such as feeding, dressing, and using the toilet facilities. Multiple chronic conditions can affect patients during any prolonged stay in a hospital bed. Long term care or any stay in a medical establishment or at a residence can involve many issues if the patient is bedridden for long period of time. Special care must be taken to assure that the patient does not suffer severe consequences from the lack of movement when forced by circumstances to stay in bed for long periods.

A critical issue relating to a bed-ridden patient is the lack of mobility on the part of the patient staying in bed. Incontinence, when confined to a bed, is a distressing problem and affects the quality of life. It is not only a distressing problem for the patient but for staff members who has to clean and care for the patient at the facilities. Bedpans and other devices can be utilized, but some patients do not have enough control to use such methods. Patients with serious incontinence issues need special care and equipment to avoid any health issues that can arise due to a patient's inability to use bedpans and other types of equipment designed for the bed-ridden patient. Hygiene is critical in maintaining the health of patients in such conditions, so the amount of time spent maintaining cleanliness and avoiding further health complications such as skin breakdown is essential. The current system relies heavily on staff to monitor and clean patients after incontinence incidents. There is a need for improved equipment designed to cope with the issue of persons suffering from incontinence in a bed-ridden condition and who are unable to utilize the current equipment that is available.

Currently, the caregiver of patients with urinary incontinence generally use waterproof mattress covers to prevent the mattress from becoming contaminated with inadvertent releases of urine. After any occurrence, the bedding then has to be changed and the patient cleaned up so they avoid skin breakdown issues or other skin lesions. Based upon patient load, sometimes this cannot occur for a few minutes, so the patient is uncomfortably sitting or lying in a wet bed, which is very disconcerting for the patient and visitors.

Existing methods uses absorbent pads, diapers, disposable bed pads or napkins which absorb and retain urine excreted. In hospitals, the person with urine-soaked protections causing discomfort, pain, cold, bedsore and other deterioration of the skin. The night incontinence also raises a more complex problem. It requires the caregiver to wake the person several times a night to check or change the protections; sleep is thereby disturbed.

Thus, there remains a need for a drain mattress system to provide convenient collection and disposal of urine from urinary incontinent patients. Further, there is also a need for a mattress arrangement by draining such fluids and evacuating them outwards, such arrangement being also intended to prevent bed sores. Further, there is also a need for a drain mattress system component that are translucent, so that waste levels and inadvertent blockages could be easily observed in the drain mattress.

SUMMARY OF THE INVENTION

The present invention discloses a drain mattress system having both mattress and a removable center inflated sections to support a patient. The removable center inflated sections provide reduced pressure against the patient's body resting on the mattress. It is understood that the drain mattress of the present invention has reduced maintenance requirements compared to other air fluidized beds.

The present invention discloses a drain mattress system which includes a mattress positioned on a steel frame of a bed. The drain mattress system is configured to have a collection tubes and a central removable collection tank. The drain mattress system configured to have drain holes that are positioned in the center of a bed frame. The center section of the drain mattress system is penetrated with a series of the collection tubes that protrude through a lower support surface of a bed frame and are connected to the collection tube, which is then collected in a funnel and directed to the central removable collection tank located under the bed. The drain mattress system is designed in such a way that fluid would automatically drain to the central removable collection tank enabling the mattress dry. The drain mattress system is attached to a suction vacuum to pull out the fluid and fecal matter.

In one embodiment, the drain mattress system center inflated sections are fixed and operate as a single unit. In a preferred embodiment drain mattress system center inflated sections are removable. The drain mattress system connections are made with an upper tube projecting into a lower tube. The collection tubes are designed to grip the other portions tightly. The drain mattress preferably formed of a relatively soft foam, such as rubber latex.

In one embodiment, drain mattress is a waterproof mattress constructed of an air-inflated. In a preferred embodiment drain mattress could be constructed of a spring type of bed mattress. The drain mattress could be constructed from a wide variety of materials including rubber, polyurethane, polyether, etc.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
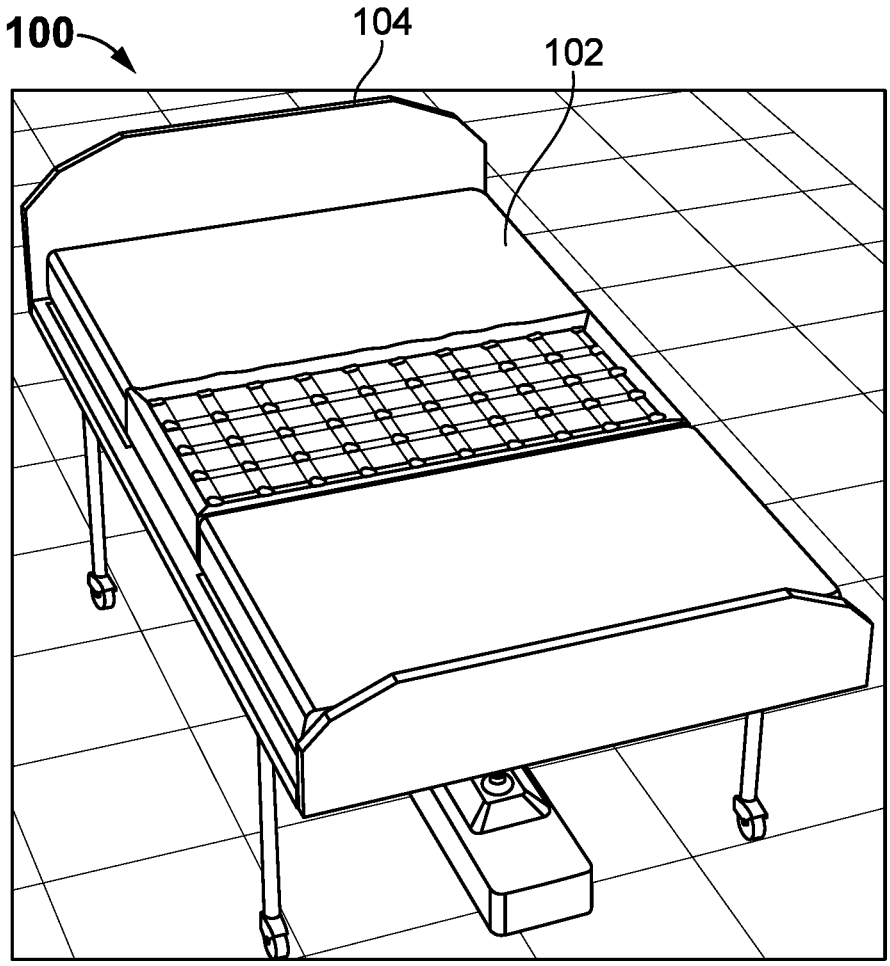
FIG. 1 shows a perspective view of a drain mattress system in an embodiment of the present invention.

FIG. 1 shows a perspective view of a drain mattress system 100 in an embodiment of the present invention. The drain mattress system 100 is designed to provide convenient collection and disposal of urine coming from urinary incontinent patients. The drain mattress system 100 comprises a bed 102, waterproof mattress positioned on a bed frame 104 which is made up of steel. The drain mattress system 100 could be assembled and disassembled for easy cleaning and disinfecting. In a preferred embodiment the drain mattress system 100 upper portion of the bed 102 is an egg crate surface with drain holes for fluid draining. The bed frame 104 is designed such that to accommodate the drain mattress system 100. The drain mattress system 100 is located under the bed frame 104. In one embodiment the drain mattress system 100 three section mattress could be supplied as a single unit. In a preferred embodiment drain mattress system 100 is made up of air, foam and spring. In one preferred embodiment, the foam used is a flexible polyurethane foam. The foam materials are materials with a sponge like, cellular structure and include, e.g., sponge rubber, plastic foams, latex foams, polyurethane foams, rubber latex and the like. In a preferred embodiment air-inflation means to inflate the drain mattress system 100 using a built-in air pump or an external air source, or other inflation means.

In one embodiment, the drain mattress system 100 center inflated sections are fixed. In a preferred embodiment drain mattress system 100 center inflated sections are removable. The drain mattress system 100 connections are made with an upper tube projecting into a lower tube and are designed to grip the other portions tightly.

Figure 2:
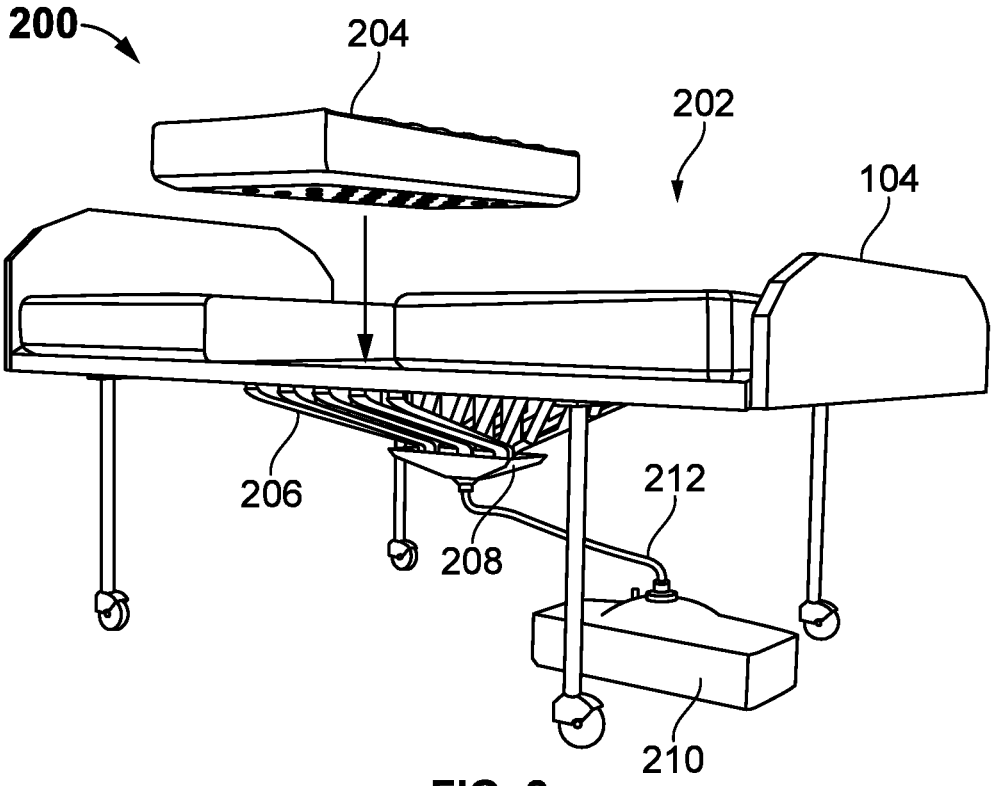
FIG. 2 shows a perspective view of the drain mattress system with a removable center inflated sections in an embodiment of the present invention.

FIG. 2 shows a perspective view of a drain mattress system 200 with a removable center inflated sections 204 in an embodiment of the present invention. The drain mattress system 200 which includes a mattress or bed 202 positioned on a bed frame 104. The drain mattress system 200 is configured to have a collection tubes 206 and a central removable collection tank 210. The bed frame 104 configured to have drain holes 214 that are positioned in the center. The center section of the drain mattress system 200 is penetrated with a series of collection tubes 206 that protrude through a lower support surface of the bed frame 104 and are connected to the collection tube, which is then collected in a funnel 208 and directed to the central removable collection tank 210 located under the bed. The drain mattress system 200 is designed in such a way that fluid would automatically drain to the central removable collection tank 210 enabling the mattress 202 dry. The drain mattress system 200 is attached to a suction vacuum to pull out the fluid and fecal matter.

In one embodiment the funnel 208 and the central removable collection tank 210 are blow molded using PVC plastic. The PVC plastic is semi-rigid and highly resistant to cracking or chipping and virtually impervious to bodily fluids and household cleansers. The funnel 208 is positioned in place using a wire support member while the central removable collection tank 210 rests upon the floor. The central removable collection tank 210 acting as a catch basin has a lid and molded in handles that allow easy transportation of the basin for emptying and cleaning. The lid is latched in place and could be removed to tip out the collected waste. After rinsing and cleanup, the central removable collection tank 210 could be positioned down to the bed and the connecting tube 212 is reattached.

Figure 3:
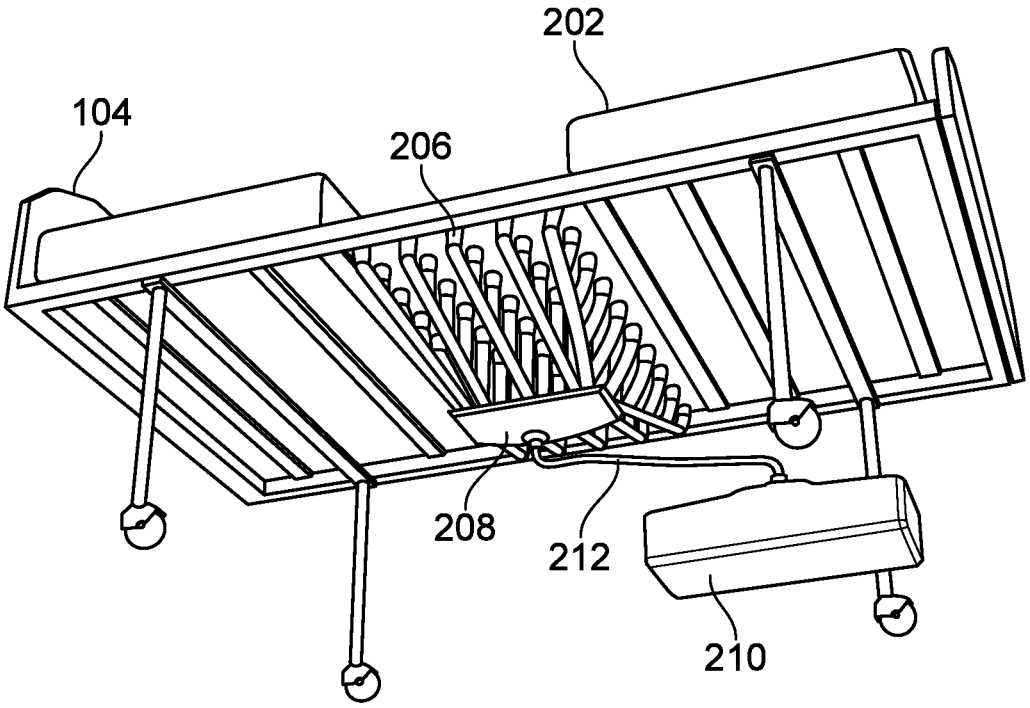
FIG. 3 shows a perspective view of a collection tubes of the drain mattress system with the removable center inflated sections in an embodiment of the present invention.

FIG. 3 shows a perspective view of a collection tubes 206 of the drain mattress system 200 with the removable center inflated sections 204 in an embodiment of the present invention. The drain mattress system 200 keeps the bed 202 surface dry upon which the patient is sitting or lying. The drain mattress system 200 consists of a specially constructed bed frame 104, which supports the back of the patient. The removable center inflated sections 204 is slightly tapered (at 0.25" per foot) such that waste migrates to the center and is intercepted into a drain tubes which then pass toward the center. The drain mattress system 200 is made up of a closed cell foam which is covered with a synthetic rubber surface. The drain mattress system 200 protects the patient's skin and the fluid dries rapidly as it passes through drain tubes. The drain mattress system 200 drying action provides a dry surface for the patient while they are lying upon the mattress surface and does not require any bedding except that over the patient. The drain mattress system 200 is constructed such that it could easily washed, rinsed, and allowed to air dry when the patient is lifted off of it. The drain mattress system 200 could be disassembled, cleaned, and reassembled easy and improves the comfort of the patient.

In one embodiment the collection tubes 206 is made up of three different types of tubing. In a preferred embodiment the first is a more rigid PVC tubing that is adhesively bonded into the bed frame 104 center section and projects downward through the mattress and bed frame 104. The collection tubes 206 are recessed slightly below the mattress surface on the top side such that the patient body is not harmed. The collection tubes 206 are adhesively bonded in position to ensure that the waste is collected in an efficient way and prevent spilling around the collection tubes 206. The collection tubes 206 are rigid and are connected the bed frame 104. In a preferred embodiment the second collection tubes 206 pass through between the mattress and the funnel 208. The collection tubes 206 is made up of PVC and could be sized to meet requirement and provide tight grip to the connecting tube 212 located below the funnel 208. The collection tubes 206 conduct the waste from the mattress to the funnel 208 which is centrally location and the collection tubes 206 are bundled together and secured in position. In a preferred embodiment the third connecting tube 212 runs from the funnel 208 to the central removable collection tank 210.

Figure 4:
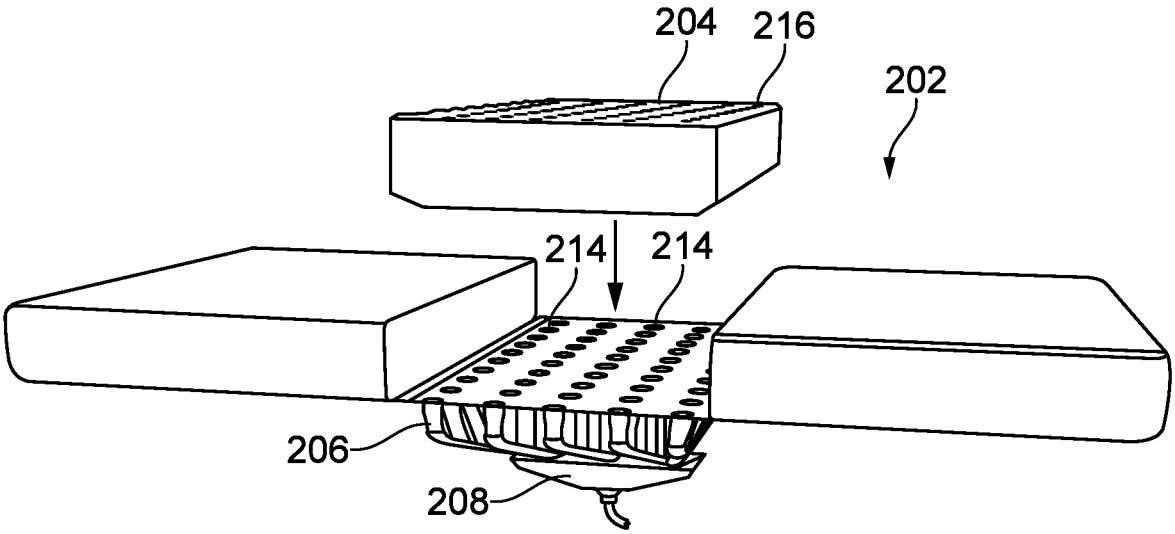
FIG. 4 shows a perspective view of removable center inflated sections of the drain mattress system in an embodiment of the present invention.

FIG. 4 shows a perspective view of removable center inflated sections 204 of the drain mattress system 200 in an embodiment of the present invention. In the drain mattress system 200, bed frame 104 having drain holes 214 to prevent any pooling of liquids. The removable center inflated sections 204 also comprises drain holes 216 which is positioned in the centre of the bed frame 104. The mattress 202 of the drain mattress system 200 is constructed of three sections that are molded to fit tightly together on the bed frame 104. In a preferred embodiment the drain mattress system 200 is made up of closed cell EVA (Ethylene Vinyl Acetate) foam which is supplied in three densities to create soft, medium, or firm mattresses 202 and is coated with synthetic rubber to modify the surface for additional comfort. The EVA foam is a closed cell material and would not absorb any fluids. After molding, the three sections make a mattress of 36" wide by 80" long. The removable center inflated sections 204 is molded with a multiplicity of drain holes 216 that could accept the rigid PVC tube which form the collection tube 206. The synthetic rubber is applied to the molded foam sections, coating them with a 10-mil thick coating that modifies the external surface of the foam. A waterproof coating on the drain mattress system 200 has good substrate adhesion, and good tensile strength, and provides a very smooth surface which is not abrasive to the patient skin. The drain mattress system 200 which is made up of synthetic rubber coating could be manufactured in vibrant and distinctive color to dramatically improve the aesthetic appearance.

Figure 5:
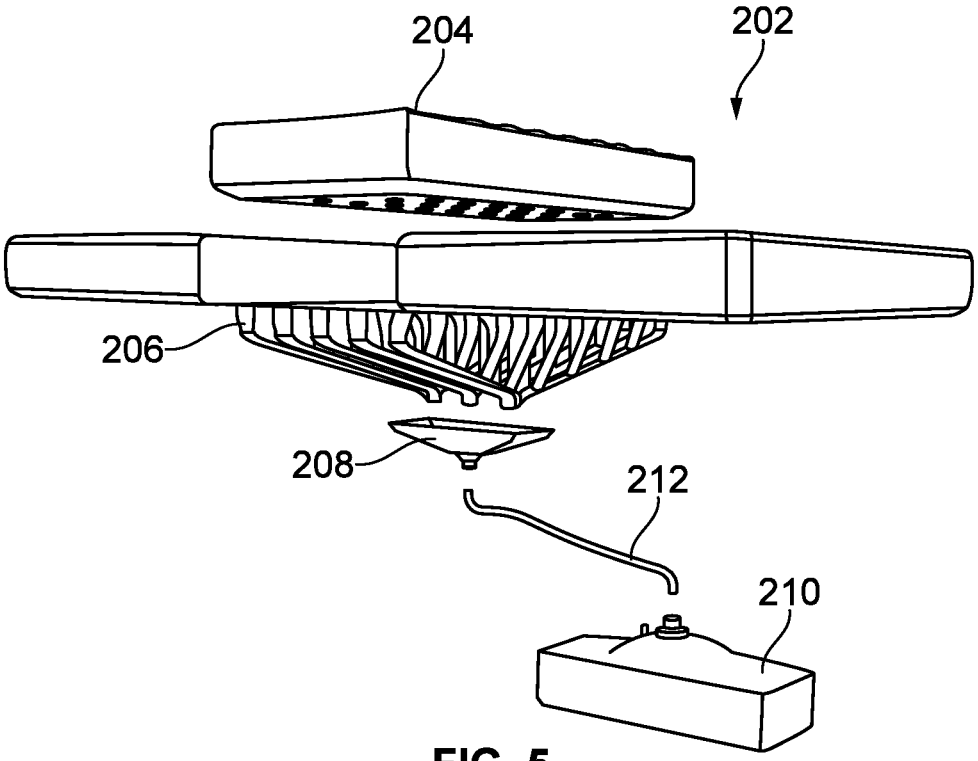
FIG. 5 shows an exploded view of the drain mattress system with the removable center inflated sections in an embodiment of the present invention.

FIG. 5 shows an exploded view of the drain mattress system 200 with the removable center inflated sections 204 in an embodiment of the present invention. In a preferred embodiment the removable center inflated sections 204 of the drain mattress system 200, the funnel 208, the connecting tube 212 and the collection tubes 206 operates as a tubular collection system, and the central removable collection tank 210 operates as the catch basin. The collection tubes 206 project through the lower steel support sheet and lead to the funnel 208 which is centrally located for effective draining. An air vent is located in the central removable collection tank 210 which allows the venting of air from the fecal storage. In a preferred embodiment the drain mattress system 200 could be downsized and adjusted to fit other applications, such as wheelchairs, patient's room chairs, bariatric chairs, etc. The the collection tubes 206 and the central removable collection tank 210 could be manufactured from the same materials as deployed on the bed.

In one embodiment, the drain mattress system 100, bed frame 104 is made up of steel angle and tubular steel tubing. The 1" steel angle is cut to accept a standard 36" wide by 80" mattress. The steel angle is welded and inserts for the 2" tubular legs are welded in place. Then the hydraulically bent 1" square steel is formed for the head and footboards and welded in place. The drain mattress system 100 three support plates are cut to shape from 0.187" thick steel sheet using the water jet machining center. The drain mattress system 100 legs are cut to length from 2" square tubing and the brake lock casters are welded in place. The 0.5" steel gussets are cut to shape from 0.25" steel sheet using a water jet machining center. After fabrication, the steel components are cleaned, the casters masked off, the steel coated with powder paint, and the paint is thermally cured. In a preferred embodiment 1.5" or 2.0" angle iron is used for supporting a 400-pound patient. The bed frame 104 could be manufactured such that the patient could raise or lower the mattress at their head and/or feet. The drain mattress system 100 used in standard hospital bed mechanisms uses linear actuators with remote or frame mounted controls. The drain mattress system 100 center section is fixed and made up of waterproof, flexible synthetic material.

Figure 6A:
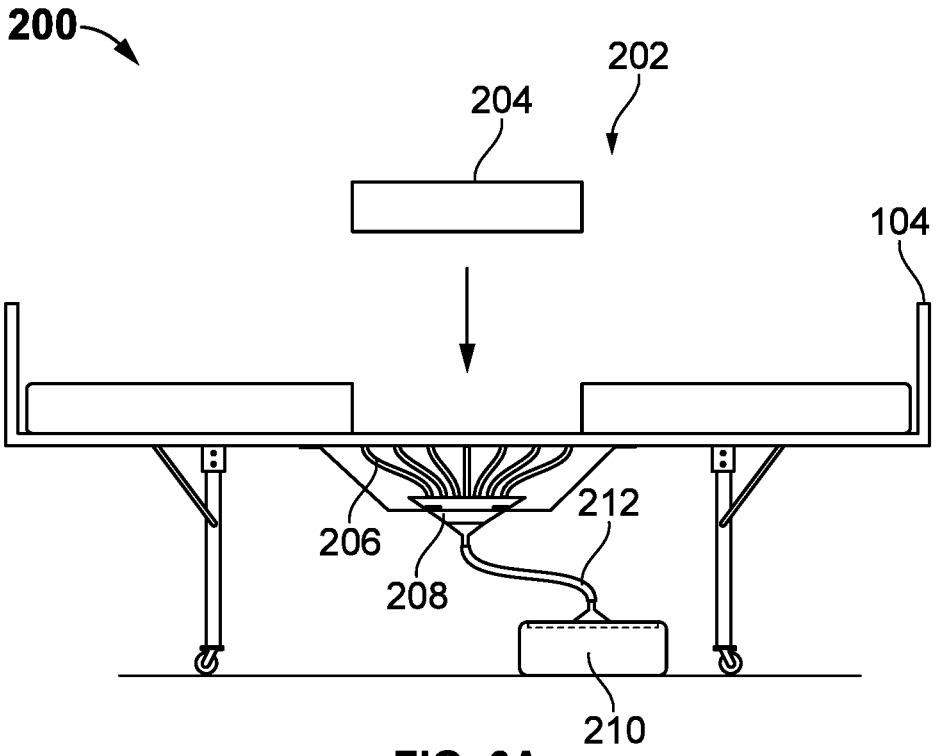
FIG. 6A shows a side view of the drain mattress system for use in an embodiment of the present invention.

FIG. 6A shows a side view of the drain mattress system 200 for use in an embodiment of the present invention. In one embodiment the bed frame 104 is made up of steel and sized to support up to a 400-pound person. The drain mattress system 200 gussets prevent the legs from folding under and support the ends of the bed. The drain mattress system 200 is designed for easy cleaning with soap and water to clean. The mattress 202 and the collection tubes 206 are highly resistant to human waste materials and household cleansers. The drain mattress system 200 is sized to meet hospital bed dimensional requirement. The funnel 208 positioned in center and collects the fluid and supported by a wire support frame, which slides into molded clips. The mattress 202, the collecting tube 206, and other collection components are made up of plastic and are easy to assemble and disassemble. The drain mattress system 200 are impervious to urine, fecal matter, and household chemicals when used for cleaning. The central removable collection tank 210 is easily removed from the drain mattress system 200 for waste disposal.

Figure 6B:
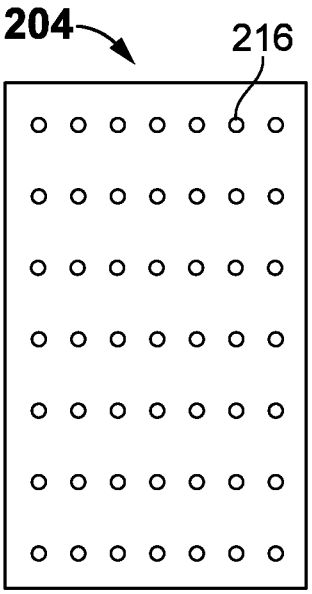
FIG. 6B shows a side view of the removable center inflated sections in an embodiment of the present invention.

FIG. 6B shows a side view of the removable center inflated sections 204 in an embodiment of the present invention. The drain mattress system 200, removable center inflated sections 204 are made up of foam and the collecting tube 206 connects the mattress 202 to the funnel 208 which is centrally located. The removable center inflated sections 204 forms the middle section and slopes toward the center such that the urine does not flow outward. The drain mattress system 200, allows the fluid to be captured by the collection tubes 206 and prevent the fluid from flowing off in the edge of the mattress 202. The collection tubes 206 are fabricated from translucent plastic such that any residual material could be observed. In a preferred embodiment the removable center inflated sections 204 configured to have 49 drain holes 216 and are connected to the collection tubes 206 for efficient draining.

Figure 7A:
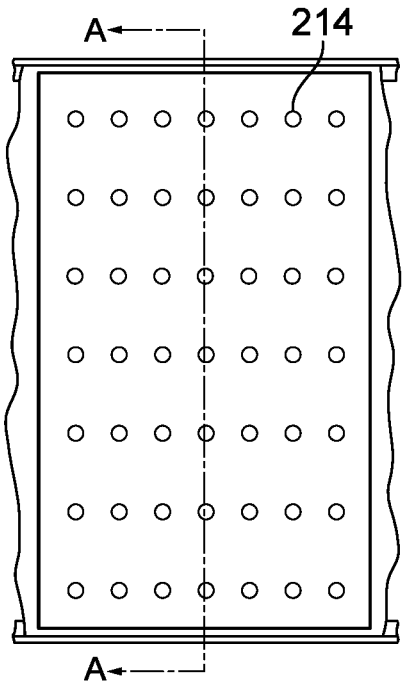
FIG. 7A shows a top view of the drain hole of the bed frame in an embodiment of the present invention.

FIG. 7A shows a top view of the drain holes 214 of the bed frame 104 in an embodiment of the present invention. The mattress 202 used for drain mattress system 100 is made up of medium density EVA foam and center section is coated with synthetic rubber which allows for easy cleaning. The mattress 202 drain holes 216 allows for efficient draining. The mattress 202 provides comfort during use. The collection tubes 206 are made up of plastic which are adhesively bonded to the bed frame 104 to prevent leakage.

Figure 7B:
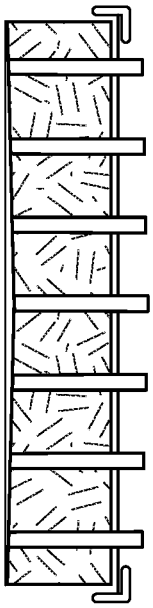
FIG. 7B shows a section view of the drain hole of the bed frame in an embodiment of the present invention in an embodiment of the present invention.

FIG. 7B shows a section view of the drain holes 214 of the bed frame 104 in an embodiment of the present invention in an embodiment of the present invention. The top of the center section of the bed frame 104 slopes at 0.25" per foot toward the center to drain any errant fluids, such that fluids are intercepted and captured in the funnel 208 and pass to the central removable collection tank 210.

Figure 7C:
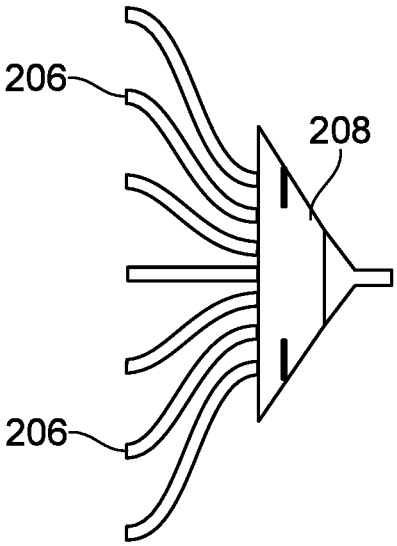
FIG. 7C shows a side view of a collection tube in an embodiment of the present invention.

FIG. 7C shows a side view of a collection tube 206 in an embodiment of the present invention. The collection tube 206 connected to the funnel 208 and pass the fluid to central removable collection tank 210 which is easy to remove, dump, rinse, and replace. The central removable collection tank 210 are translucent such that waste levels and inadvertent blockages could be easily observed. The collection tube 206 are appropriately connected to the drain holes 214 of the bed frame 104 for efficient draining.

Figure 8A:
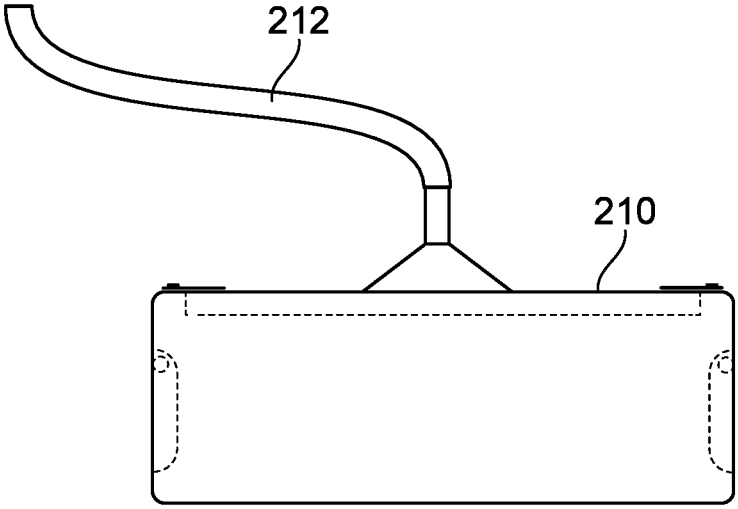
FIG. 8A shows a front view of the central removable collection tank in an embodiment of the present invention.

FIG. 8A shows a front view of the central removable collection tank 210 in an embodiment of the present invention. The central removable collection tank 210 is a blow molded catch basin having a thick wall to allow harsh materials and prevents degradation. The lid with the integral funnel 208 is secured to the central removable collection tank 210 using connecting tube 212. The connecting tubes 212 are fixed using rotating latches and could be removed for dumping and easy cleaning.

Figure 8B:
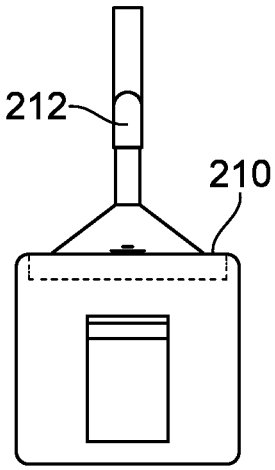
FIG. 8B shows a side view of the central removable collection tank in an embodiment of the present invention

FIG. 8B shows a side view of the central removable collection tank 210 in an embodiment of the present invention. The funnel 208 allows watertight connection to the connecting tube 212 such that the urine and solids flow into the central removable collection tank 210 without any leakage.

In one embodiment the drain mattress system 100 is a waterproof mattress constructed as an air-inflated, foam or spring type of bed mattress 102. The drain mattress system 100 is to aid health care workers with patients suffering from incontinence by draining fluids from the patient's bed. The drain mattress system 100 improve hygiene and comfort of the patient as well as saving time and effort of health care and home care workers. The drain mattress system 100 improve the sanitation of patients who suffer from incontinence by keeping the patient free of skin breakdowns. The drain mattress system 100 prevents exposure of bacteria affection the patients, due to the presence of urine and faecal matter in the patient beds. The drain mattress system 100 helps health care facilities and home care for patients and workers and improves health of bed-ridden patients. The drain mattress system 200 center section are removable which allows easy assembling and disassembling. The drain mattress system 200 eliminates pooling of fluids. The drain mattress system 200 is easily washable. The removable collection tank 210 of the drain mattress system 200 is installed easily and changed regularly for draining fluid and other solid matters.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. A drain mattress system to drain a drain mattress, comprising:
   - the drain mattress being positioned on a bed frame of a bed and including a plurality of drain holes to permit passage of fecal matter from an upper surface therethrough to a lower surface;
   - the bed frame having a plurality of drain holes;
   - a plurality of collection tubes adhesively bonded to the bed frame in alignment with the plurality of drain holes;
   - a removable collection tank coupled to the plurality of collection tubes;
   - a vacuum device to generate a vacuum to remove debris from the drain mattress.

2. The drain mattress system to drain a drain mattress as in claim 1, wherein the drain holes are positioned in a center of the bed frame.

3. The drain mattress system to drain a drain mattress as in claim 1, wherein the collection tubes extend through a lower support surface of the bed frame.

4. The drain mattress system to drain a drain mattress as in claim 1, wherein the collection tubes are connected to a central collection tube.

5. The drain mattress system to drain a drain mattress as in claim 4, wherein the central collection tube is connected to a funnel and directed to the removable collection tank located under the bed.

6. The drain mattress system to drain a drain mattress as in claim 1, wherein the debris includes fluid and said fecal matter.

7. The drain mattress system to drain a drain mattress as in claim 1, wherein the collection tank is positioned central to the drain mattress.

8. The drain mattress system to drain a drain mattress as in claim 1, wherein the drain mattress includes an inflated section.

9. The drain mattress system to drain a drain mattress as in claim 8, wherein the inflated section is fixed.

10. The drain mattress system to drain a drain mattress as in claim 8, wherein the inflated section is removable.

11. The drain mattress system to drain a drain mattress as in claim 1, wherein the drain mattress is formed from soft foam.

12. The drain mattress system to drain a drain mattress as in claim 1, wherein the drain mattress is formed from rubber.

* * * * *